US006490774B2

(12) United States Patent
Carter

(10) Patent No.: US 6,490,774 B2
(45) Date of Patent: Dec. 10, 2002

(54) ADDED COIN COMPARTMENTS FOR CURRENT CASH TILLS

(76) Inventor: Odie Kenneth Carter, 2391 Oaks Blvd., Naples, FL (US) 34119

( * ) Notice: Subject to any disclaimer, the term of this patent is extended or adjusted under 35 U.S.C. 154(b) by 0 days.

(21) Appl. No.: 09/790,933

(22) Filed: Feb. 22, 2001

(65) Prior Publication Data

US 2001/0032790 A1 Oct. 25, 2001

Related U.S. Application Data

(60) Provisional application No. 60/184,041, filed on Feb. 22, 2000.

(51) Int. Cl.[7] ..... G07G 1/00

(52) U.S. Cl. ..... 29/401.1; 206/0.84; 206/514; 235/7 R

(58) Field of Search ..... 206/0.8, 0.81–0.84, 206/514; 215/379, 380, 382–384, 400; 220/660, 661, 676, 495.01; 235/7 R; 29/401.1

(56) References Cited

U.S. PATENT DOCUMENTS 1,349,527 A * 8/1920 Owen ..... 206/0.81
1,890,587 A * 12/1932 Plym ..... 206/0.81
2,155,549 A * 4/1939 House ..... 206/0.81
2,343,936 A * 3/1944 Showers, Jr. ..... 206/0.81
2,522,768 A * 9/1950 Wiepert ..... 206/0.81
2,594,653 A * 4/1952 Jertson ..... 206/0.81
4,314,632 A * 2/1982 Hutchinson ..... 206/0.81
4,786,785 A * 11/1988 Felt ..... 235/7 R
5,168,987 A * 12/1992 Warwicker ..... 206/0.81
5,756,977 A * 5/1998 Biss ..... 235/7 R
5,829,628 A * 11/1998 Lount ..... 220/660

* cited by examiner

*Primary Examiner*—Jim Foster
(74) *Attorney, Agent, or Firm*—Hovey Williams LLP

(57) ABSTRACT

A method and apparatus for inexpensively retrofitting existing cash register tills with an insert comprising a coin cup holder designed to fit into an existing bill slot for stabilizing coin cups. The coin cup holder allows the coin cup to rest evenly without rocking, and the coin cup can be removed from the till for ease of counting coins. A special coin cup is provided designed to rest in the coin cup holder and comprising a notch in one of the walls to allow it to pass the attachment points of a bill weight typically provided in existing cash tills to hold down bills in the bill slots.

7 Claims, 2 Drawing Sheets

PRIOR
ART

ADDED COIN COMPARTMENTS FOR CURRENT CASH TILLS

RELATED APPLICATIONS

The present application relates to and claims priority with regard to all common subject matter of provisional patent application titled "Added Coin Compartments for Current Cash Tills," Ser. No. 60/184,041, filed Feb. 22, 2000. The identified provisional patent application is hereby incorporated into the present application by reference.

BACKGROUND OF THE INVENTION

1. Field of the Invention

The present invention relates to cash register till design. More particularly, the invention relates to a method and apparatus for retrofitting existing cash tills to accommodate extra coin holders.

2. Description of the Prior Art

Currently, there is a large installed base of cash register tills that are typically designed to hold four or five different types of coins. The same tills also typically have a like number of currency slots for holding different denominations of bills. FIG. 1 shows a perspective view of a typical prior art cash register till having five bill slots and five coin compartments. The U.S. Mint has decided to release a new one dollar coin and possibly new two and five dollar coins. This has created a need for retailers to be able to handle these new coin types efficiently. Absent some way to increase coin holders in existing cash register tills, merchants will have to either purchase new tills with additional coin compartments already present to accommodate the new coin types or decide not to hold some coin types in the cash register till.

Accordingly, there is a need for a new method and apparatus to inexpensively retrofit the large installed base of cash register tills to allow for efficient handling of additional coin types as they are placed into circulation.

SUMMARY OF THE INVENTION

The present invention solves the above-described problems and provides a distinct advance in the art of cash register till design. More particularly, the present invention provides a method and apparatus for inexpensively retrofitting existing cash register tills that provides inserts designed to fit into existing bill slots for stabilizing additional coin cup holders.

The apparatus of the present invention broadly includes an insert for holding coin cups in a cash till bill slot. A special coin cup is provided designed to rest in the coin cup holder and comprising a notch in its back wall to allow it to pass under the attachment points of a bill weight typically provided in existing cash tills to hold down bills in the bill slots. The coin cup holder allows the coin cup to rest evenly without rocking and can be removed from the till for ease of counting. The coin cup holder and coin cup may be made of any appropriate size to fit into various existing bill slots.

By constructing coin cup inserts and coin cups as described herein, numerous advantages are realized. For example, relatively inexpensive retrofits of existing cash tills are possible, substantially reducing the cost to merchants in accommodating new coin types as they are put into circulation by government authorities.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

Figure 2:
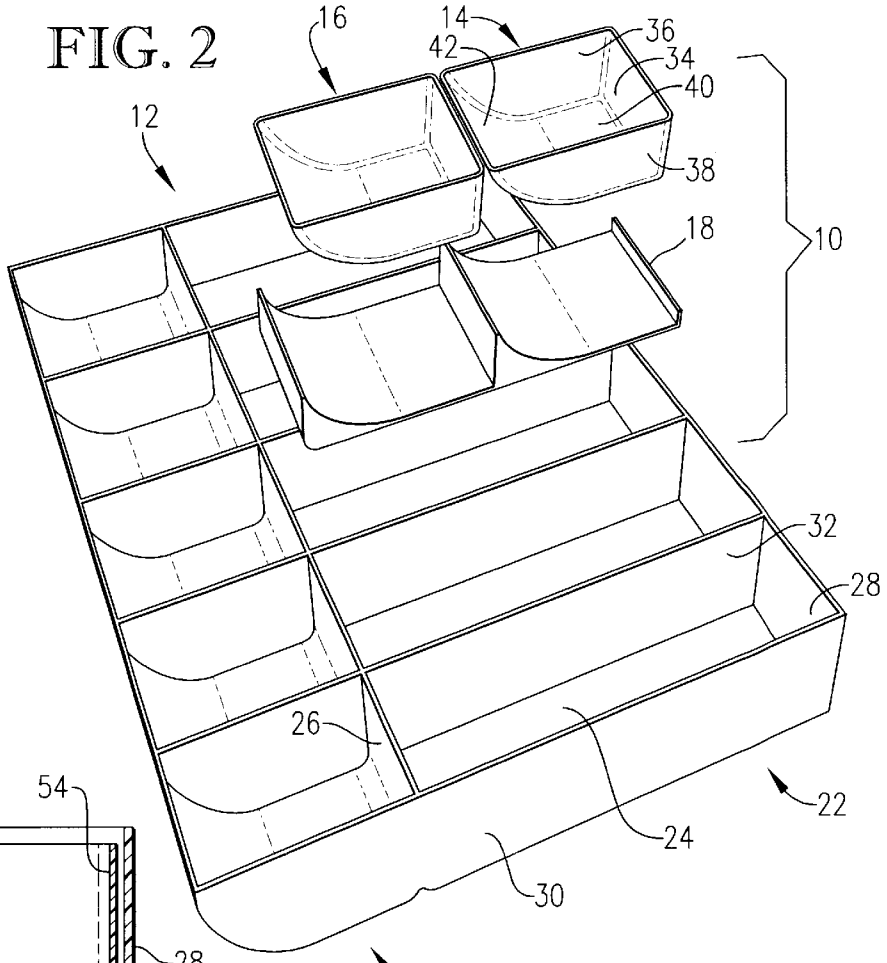
FIG. 2 is a perspective view of a coin cup holder and coin cups constructed in accordance with a first preferred embodiment of the present invention.
Figure 1:
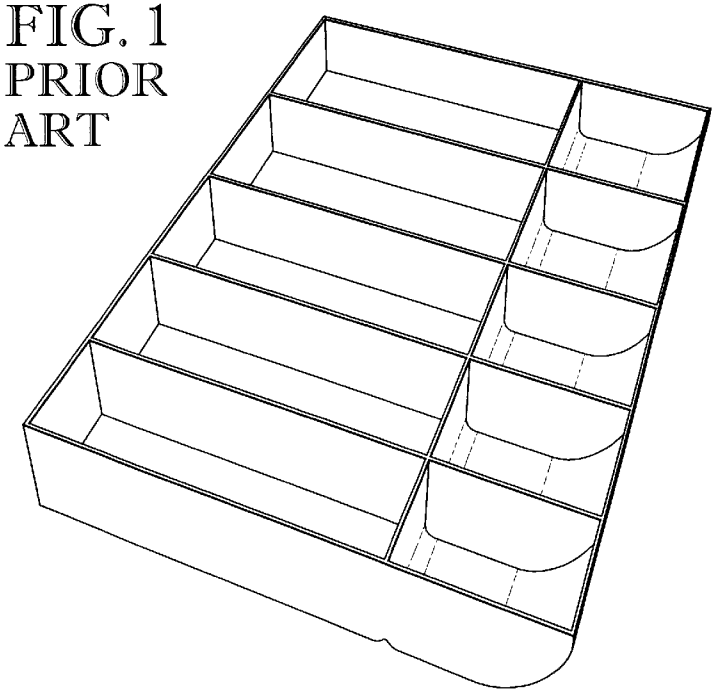
FIG. 1 is a perspective view of a prior art cash register till.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Turning now to the drawings and particularly to FIG. 2, a perspective view of one embodiment of the present invention is shown. In FIG. 2 a retrofit assembly 10 of a preferred embodiment of the present invention is shown above a cash register till 12 of the prior art. The cash register till includes 5 existing coin compartments 20 and 5 existing bill slots 22. Each bill slot includes a horizontally-extending floor 24, an upstanding front wall 26, an upstanding rear wall 28, as well as 2 upstanding sidewalls 30, 32. Retrofit assembly 10 comprises two coin cups 14, 16 and coin cup holder 18. Coin cups 14 and 16 are identical in construction. Each has an upstanding rearwall 34, two upstanding sidewalls 36, 38, and a horizontally extending floor 40 which curves upward forming a curved front wall 42. Coin cup holder 18 is configured to be inserted within an existing bill slot and attached to floor 24 by means of glue, tape or other appropriate means so that it fits within the bill slot and does not move around after insertion. The coin cup holder and coin cup may be made of wood, plastic, metal, or any other suitable material.

Figure 3:
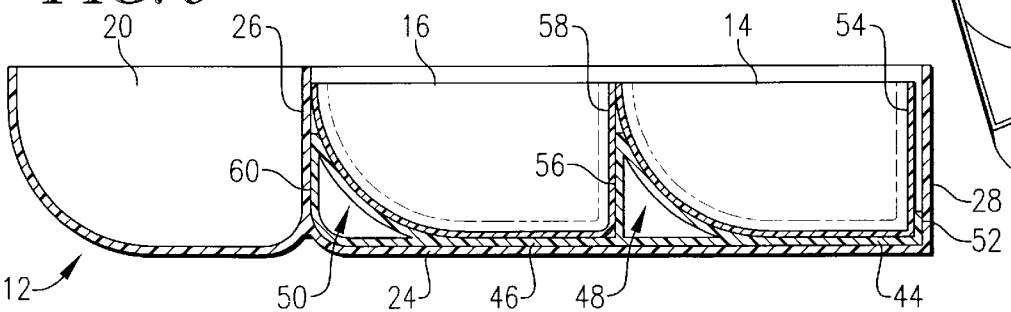
FIG. 3 is a cross-sectional view of a cash register till with a coin cup holder and coin cups inserted into a bill slot.

FIG. 3 shows a cross-sectional view of a cash register till 12 with retrofit assembly 10 inserted therein. Coin cup holder 18 is designed to hold two coin cups and has two horizontally-extending floor regions 44, 46 which each curve upward at regions 48, 50. Curved floor regions 48, 50 are configured to receive the front curved floor of coin cups 14, 16 respectively. The curved regions 48, 50 of the coin cup holder prevent the curved coin cups from rocking after they have been inserted into the holder. The coin cup holder has a small rearward sill 52 extending vertically from horizontal floor 44. Although rearward sill 52 is shown resting flush against rearward till wall 28, a gap may also exist between these structures. The rearward wall 54 of the rearmost coin cup 14 fits flush against rear sill 52. Likewise, a vertical sill 56 extends from approximately the mid-point of the coin cup holder floor up to the top edge of coin cup holder curved section 48 creating a partition in coin cup holder 18. Sill 56 is designed to hold the rearward wall 58 of front coin cup 16. A front vertical sill 60 extends down from curved region 50 and fits flush against upstanding front wall 26 of bill slot 22. Coin cup holder 18 will be positioned toward the front of the till making front coin cup 16 rest against the rear of wall 26.

Figure 4:
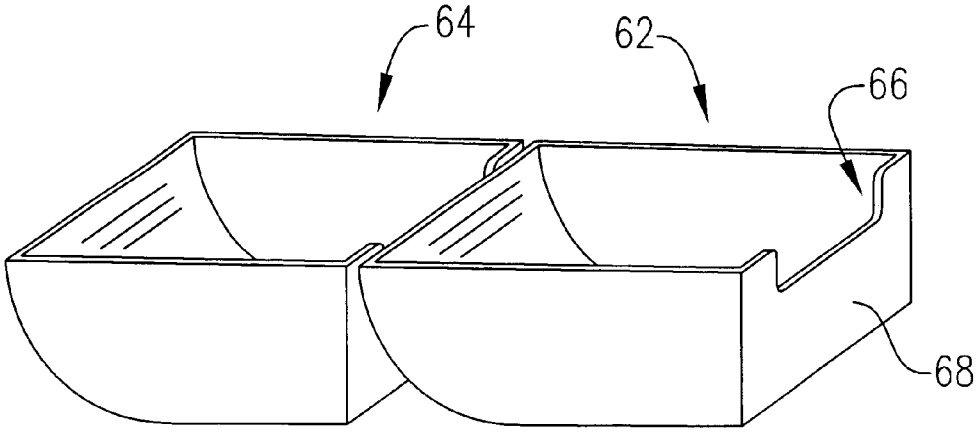
FIG. 4 is a perspective view of coin cups constructed in accordance with second preferred embodiment of the present invention.

FIG. 4 shows another embodiment of the present invention. This embodiment differs from that of FIGS. 2 and 3 in that the coin cups 62, 64 each have a rearward notch 66 formed in rear wall 68. Many cash register tills have bill weights attached at the rear of their bill slots. Notch 66 is present in coin cup 62, 64 to allow either coin cup to be inserted under the bill weight attachment points. The bill weight itself should be removed from a slot into which the retrofit assembly will be inserted.

Although the invention has been described with reference to the preferred embodiment illustrated in the attached drawing figures, it is noted that equivalents may be employed and substitutions made herein without departing from the scope of the invention as recited in the claims. For example, the coin cup holder may have additional partitions and be configured to hold more than two coin cups. Likewise, the coin cups need not have a curved floor and the coin cup holder may be altered to accommodate coin cups that do not have curved floors. Likewise, the invention could be installed in any or all of the bill slots of a cash register till.

As clearly shown in FIG. 3, each sill 52,56,60 is a substantially vertical wall. The rearward sill 52 holds the coin cup 14 firmly in place against the curved region 48 and the coin cup 16. The sill 56 similarly holds the coin cup 16 firmly in place against the curved region 50 and the front wall 26 of the bill slot 22. Together, the rearward sill 52 and the vertical sill 60 hold the coin cup holder 18 firmly in place between the rear wall 28 and the front wall 26 of the bill slot 22.

What is claimed is:

1. A method of retrofitting a cash register till comprising:

providing a till;

inserting a coin cup holder into a bill slot of the till, wherein the cup holder is dimensioned to fit within the bill slot of the till and comprising a partition and two curved floor sections;

inserting two coin cups dimensioned to fit snugly within the cup holder.

2. The method as set forth in claim 1, wherein each of the cups includes a chamber having a substantially flat rear wall and a floor which curves upward forming a curved front wall such that coins are easily removed from the chamber.

3. The method as set forth in claim 2, wherein at least one of the cups has a notch in the rear wall.

4. The method as set forth in claim 2, wherein the bill slot has a substantially rectangular plan view and the cups are approximately half as long as the bill slot.

5. The method as set forth in claim 4, wherein the rear wall of a first one of the cups is placed adjacent the front wall of a second one of the cups such that the cups are placed within the holder in a front-to-back configuration rather than side-by-side.

6. The method as set forth in claim 2, wherein each of the coin cups further comprises two substantially flat sidewalls.

7. The method as set forth in claim 1, wherein each of the coin cups is approximately as wide as a bill and approximately half as long as the bill slot such that the two cups occupy approximately the same area as the bill slot.

* * * * *